US006137988A

United States Patent [19]

Yonemochi

[11] Patent Number: 6,137,988

[45] Date of Patent: Oct. 24, 2000

[54] RECORDING DEVICE HAVING A SHEET LOADING SYSTEM

[75] Inventor: Masaru Yonemochi, Tokyo, Japan

[73] Assignee: NEC Corporation, Tokyo, Japan

[21] Appl. No.: 09/325,855

[22] Filed: Jun. 4, 1999

[30] Foreign Application Priority Data

Jun. 4, 1998 [JP] Japan ..... 10-170520

[51] Int. Cl.[7] ..... G03G 15/00; G03G 21/00; B65H 23/18

[52] U.S. Cl. ..... 399/384; 226/28

[58] Field of Search ..... 399/384; 226/2, 226/28, 39, 76

[56] References Cited

U.S. PATENT DOCUMENTS

| | | | |
|---|---|---|---|
| 5,194,903 | 3/1993 | Negishi et al. | 226/28 X |
| 5,839,046 | 11/1998 | Takano et al. | 399/384 |
| 5,893,021 | 4/1999 | Yanashima | 399/384 |
| 5,901,892 | 5/1999 | Takanashi | 226/2 X |
| 5,929,894 | 7/1999 | Kikuchi | 399/384 X |

FOREIGN PATENT DOCUMENTS

| | | |
|---|---|---|
| 57-176067 | 10/1982 | Japan . |
| 58-49868 | 3/1983 | Japan . |
| 3-13362 | 1/1991 | Japan . |
| 10-120266 | 5/1998 | Japan . |

*Primary Examiner*—Fred L. Braun
*Attorney, Agent, or Firm*—Foley & Lardner

[57] ABSTRACT

An electrophotographic printer has an automated sheet loading system which adjusts the position of the continuous recording sheet by moving the sheet forward and backward so that one of the perforated lines or the recording sheet is aligned with a reference line of the printer upon depression of a key switch by an operator.

8 Claims, 8 Drawing Sheets

RECORDING DEVICE HAVING A SHEET LOADING SYSTEM

BACKGROUND OF THE INVENTION (a) Field of the Invention

The present invention relates to a recording device having a sheet loading system for loading a continuous recording sheet of paper and, more particularly, to a technique for aligning a perforated line of the continuous recording sheet with a reference line of the recording device before printing on the recording sheet.

(b) Description of the Related Art

In a conventional electrophotographic printer using a continuous sheet of paper having perforated lines for separating cut sheets from the recording sheet, the operator first aligns the sprocket holes of the recording sheet with the sprocket pins formed on the tractor of the printer. Then, the operator sets the tractor in the printer, and adjusts the perforated lines to be aligned with the reference line on the tractor while depressing a dedicated push button for skipping sprocket pins by a manual process. There is an increasing demand, however, for an automated adjustment process for aligning the perforated line of the recording sheet with the reference line in the electrophotographic printer to save the manual operation by the operator.

SUMMARY OF THE INVENTION

In view of the above, it is an object of the present invention to provide a recording device such as an electrophotographic printer having an automated loading system for loading a recording sheet at a start position of the recording sheet by aligning the perforated line of the recording sheet with a reference line of the printer.

The present invention provides a recording device for recording image on a continuous recording sheet having a plurality of perforated lines disposed at a constant pitch. The recording device includes a sheet loading system including a sheet feed mechanism for feeding the recording sheet, and a positioning unit for controlling the sheet feed mechanism to advance the recording sheet from an initial position to a start position at which one of the perforated lines is aligned with a reference position of the recording device.

In accordance with the recording device of the present invention, the sheet loading system functions for automated adjustment of the recording sheet to align the one of the perforated lines with the reference line of the printer as the start position of the recording sheet. Thus, a manual operation of the sheet adjustment by an operator is not needed.

PREFERRED EMBODIMENTS OF THE INVENTION

Now, the present invention is more specifically described with reference to accompanying drawings.

Figure 1:
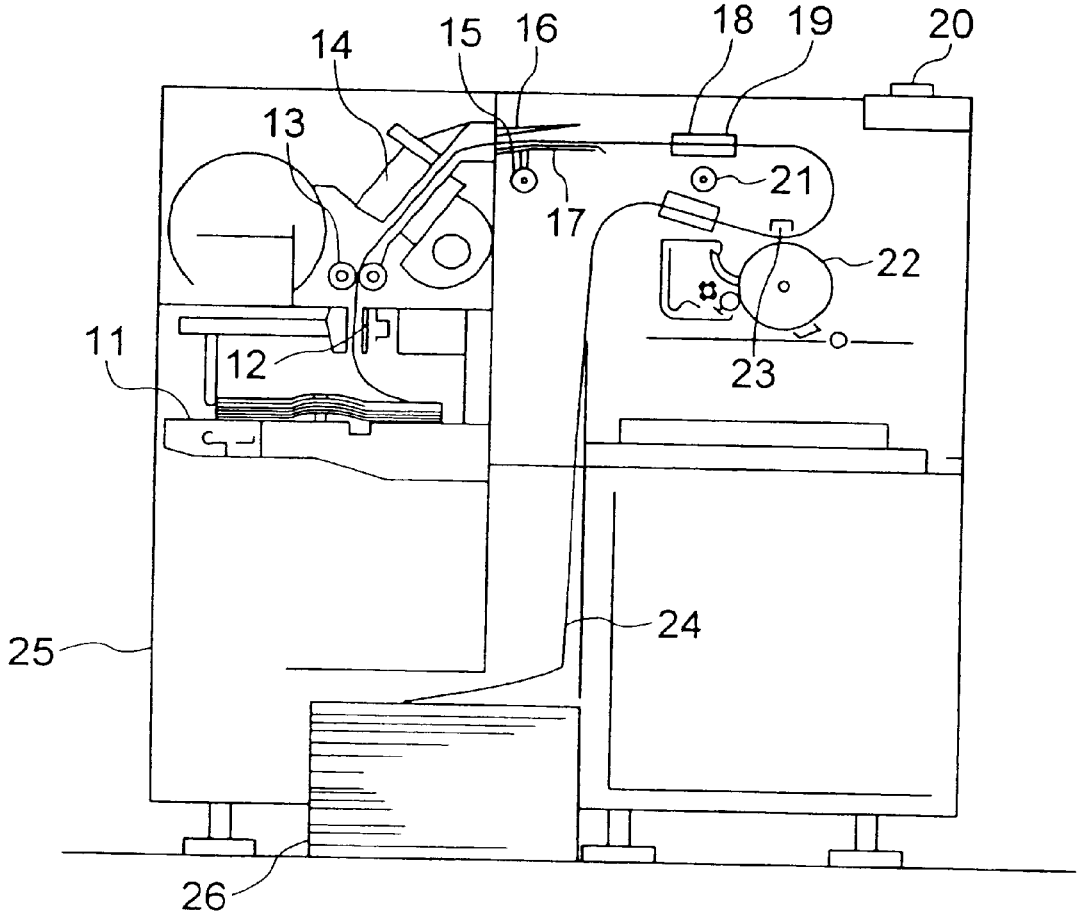
FIG. 1 is a schematic side view of an electrophotographic printer having a sheet loading system according to an embodiment of the present invention.

Referring to FIG. 1, an electrophotographic printer according to an embodiment of the present invention includes a housing 25, a transcript section implemented by an OPC drum 22 for forming a toner image on a continuous recording sheet 24, a fixing section 14 for fixing the toner image onto the recording sheet 24, and a sheet loading system provided according to the present invention and including a sheet feeder mechanism. The sheet feeder mechanism feeds the recording sheet 24 from a blank paper stack 26 through the transcript section 22 and the fixing section 14 to a stack table 11 for stacking thereon a recorded paper stack. The sheet feeder mechanism includes a feed motor 21, a tractor 19, a pair of feed assist plates 17, and a feed roll motor 13.

The sheet loading system further includes a front edge sensor 18 disposed for detecting the front edge of the continuous recording sheet 24 on the tractor 19 disposed for the transcript section, a solenoid 15 for driving the feed assist plates 17 based on a signal supplied from a plate sensor 16, a sheet feed sensor 12 for detecting the recording sheet 24 in the vicinity of the stack table 11, and a key switch 20 disposed at the top of the housing 25 for operation by an operator.

Figure 2:
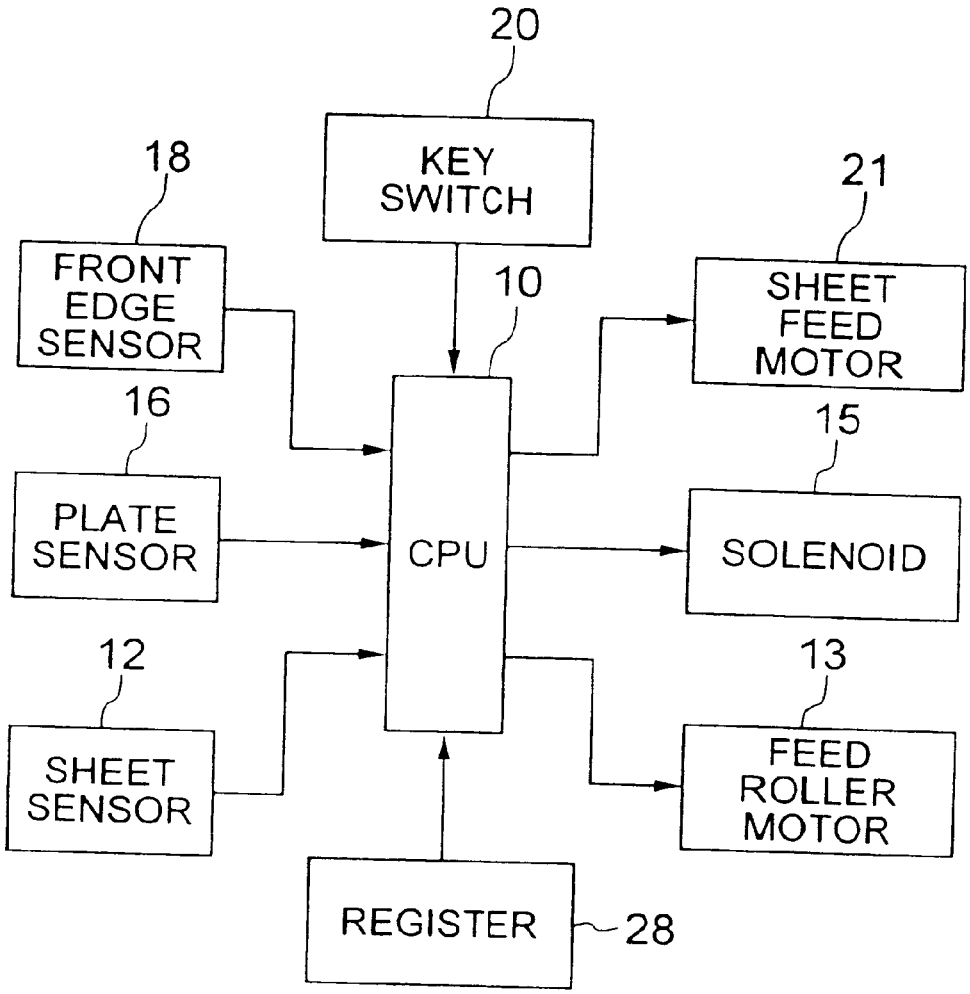
FIG. 2 is a block diagram of the sheet loading system shown in FIG. 1.

Referring additionally to FIG. 2, the overall operation of the sheet loading system is controlled by a CPU 10 which functions as a positioning unit. The sheet loading system is started by depressing the key switch 20, after a new blank paper stack 26 is provided for the electrophotographic printer and the operator engages the sprocket holes of the recording sheet 24 with the sprocket pins of the tractor 19. The sheet loading system operates for aligning one of the perforated lines of the recording sheet 24 with a reference line at the tractor 19 by controlling the sheet loading mechanism as detailed below.

The feed motor 21 provided in the vicinity of the tractor 19 of the transcript section 22 can feed the recording sheet 24 in both forward and backward directions. The feed roll motor 13 assists the feed motor 21 to feed the recording sheet 24 while the recording sheet 24 passes the fixing section 14 toward the stack table 11. The feed motor 21 provides four modes of the sheet feed, including an ordinary forward feed, an ordinary backward feed, a forward skip feed and a backward skip feed. The speed of the ordinary forward or backward feed corresponds to the speed of the feed during the printing, and the ordinary feed requires a stop operation for stopping the ordinary feed. The forward or backward skip feed corresponds to a single line of printing or a length of ⅙ inch, and automatically stops after each skip feed.

The sheet sensor 12 is operated periodically and detects a jam of the recording sheet 24 if the sheet sensor 12 does not detect a part of the recording sheet 24. A sheet length register 28 stores the specified sheet size including the sheet length as measured between the adjacent perforated lines of the recording sheet in the blank paper stack 26.

Figure 3A:
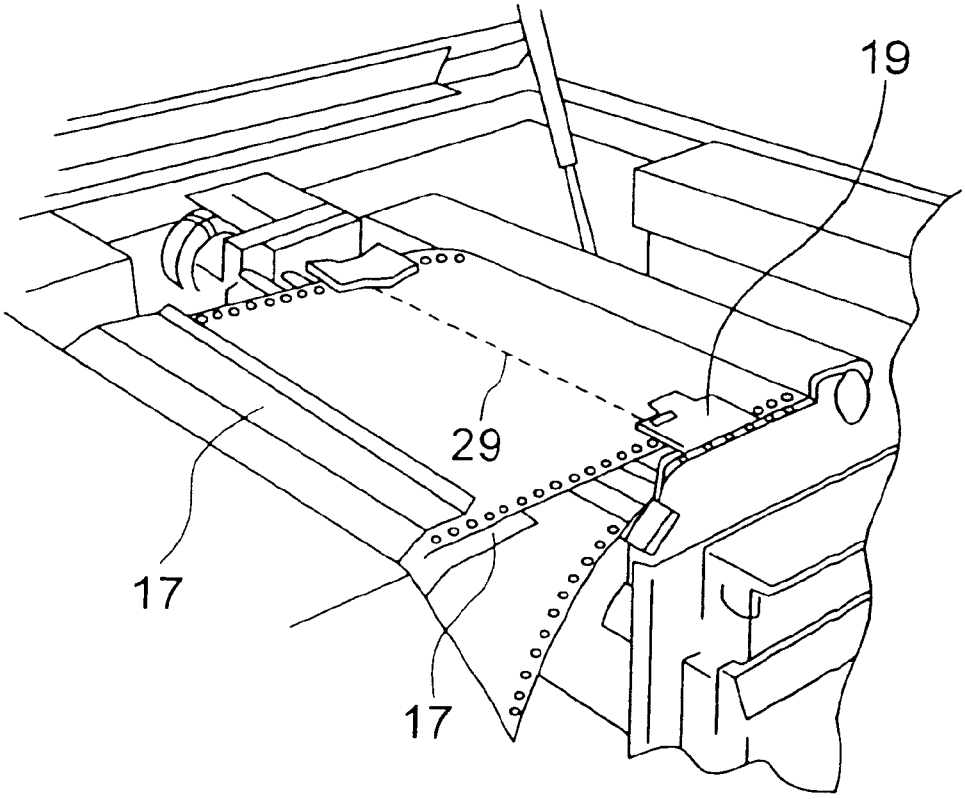
FIG. 3A is a schematic perspective view of a part of the electrophotographic printer of FIG. 1.
Figure 3B:
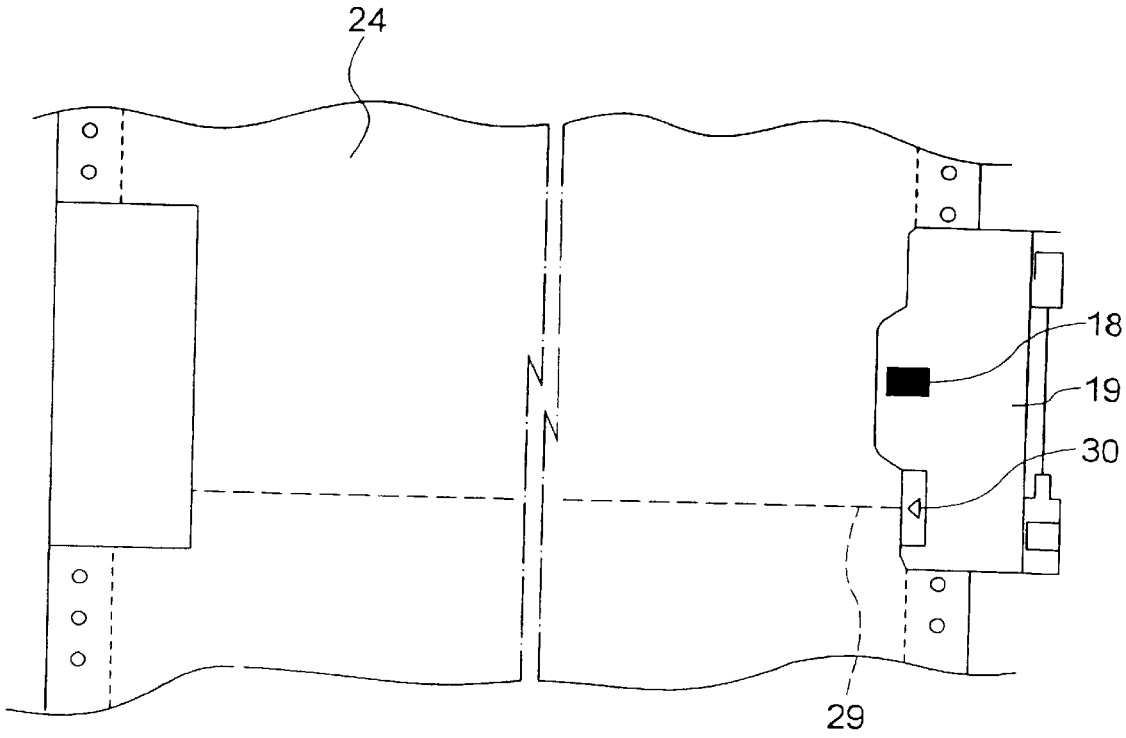
FIG. 3B is a detailed top plan view of a portion of FIG. 3A.

Referring to FIGS. 3A and 3B in addition to FIG. 1, the front edge sensor 18 is of a reflective-type photodetector which operates in association with a reflecting plate provided as a part of the tractor 19. The front edge sensor 18 is provided in the vicinity of the front edge of the tractor 19, and detects the presence of a part of the recording sheet 24 when the reflecting plate does not reflect the light emitted from the front edge sensor 18.

The feed assist plates 17, the solenoid 15 and the plate sensor 16 are provided at the fixing section 14. The feed assist plates 17 function for assisting the front edge of the recording sheet 24 to correctly enter the fixing section 14. The assist is effected when the feed assist plates 17 are raised by the solenoid 15. The feed assist plates 17, if not raised by the solenoid 15, provide a suitable tension to the recording sheet 24.

Figure 4:
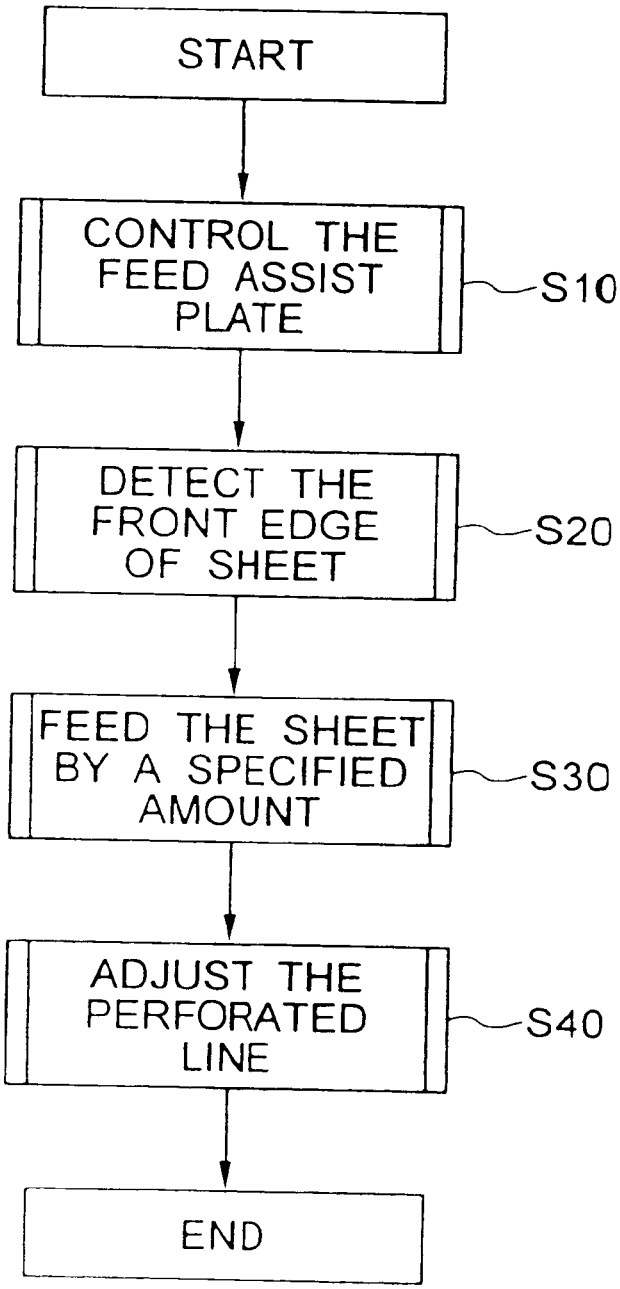
FIG. 4 is a flowchart for showing overall operation of the sheet loading system of FIG. 2.

Referring to FIG. 4, the sheet loading system operates for controlling the feed assist plates 17 at step S10, adjusting the front edge of the recording sheet to a specified position at step S20, feeding the recording sheet by a specified amount at step S30, and adjusting the location of the recording sheet to align one of the perforated lines 29 of the recording sheet 24 with a reference line 30 of the tractor 19.

Figure 5:
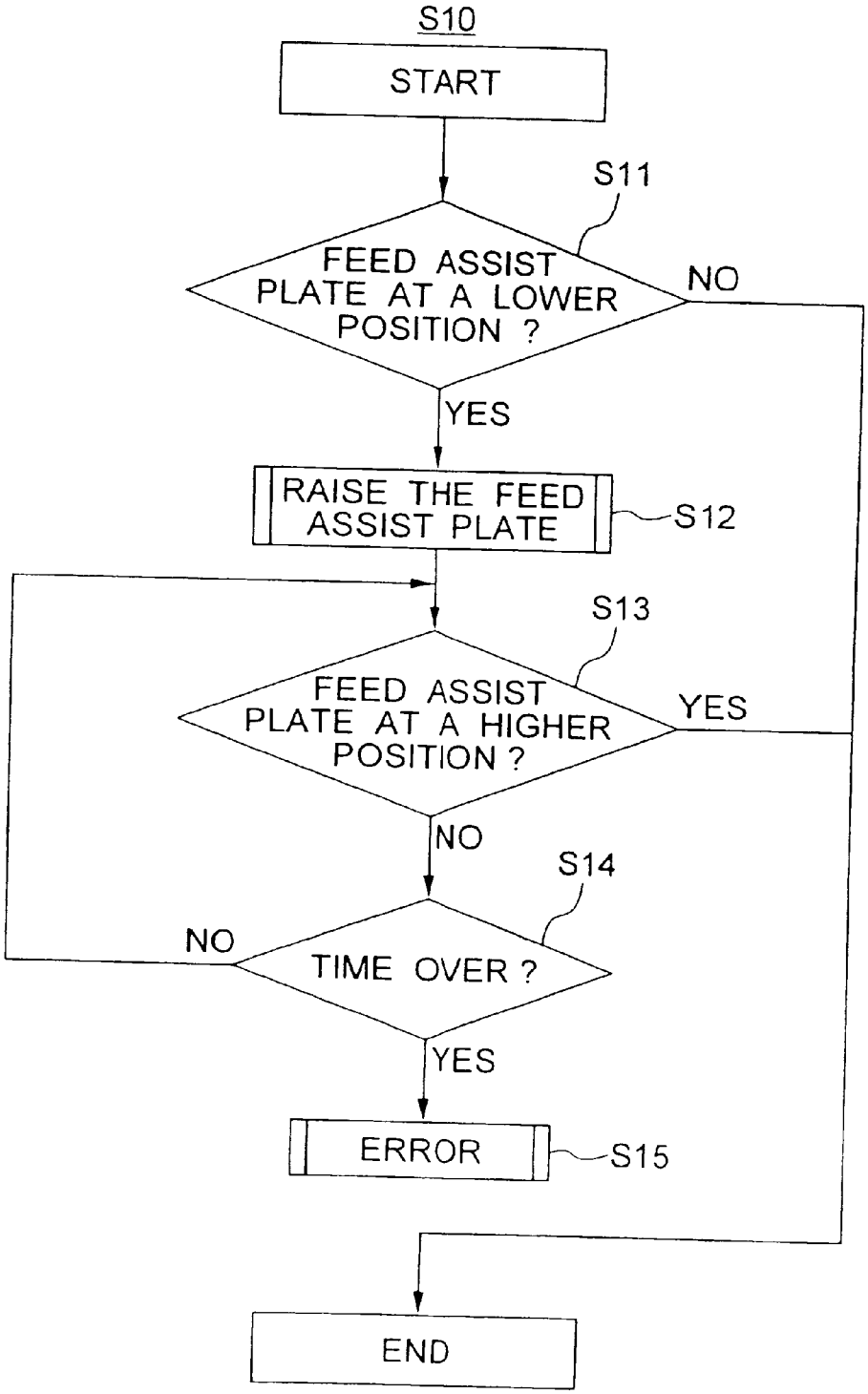
FIG. 5 is a detailed flowchart showing the steps in step 10 in FIG. 4.

Referring to FIG. 5, step S10 shown in FIG. 4 includes step 11 for judging by the plate sensor 16 whether or not the feed assist plates 17 are at a lower position, i.e., at a position not suitable for receiving the front edge of the recording sheet. If the feed assist plates 17 reside at a lower position, a process for raising the feed assist plates 17 is conducted at step S12. Then, it is judged at step S13 whether or not the feed assist plates 17 reside at a higher position suitable for receiving the front edge. If it is judged at step S13 that the feed assist plates 17 are not raised, the judgment of step S13 is iteratively conducted until it is judged at step S14 that the time interval set for operating the feed assist plates 17 is over. If it is judged at step S13 that the feed assist plates 17 are raised, or it is judged that the feed assist plates 17 are at the higher position at step S11, step S10 is successfully finished, whereby the front edge of the recording sheet can be guided to the fixing section 14. On the other hand, if the feed assist plates 17 are not raised within the specified time, an alarm for control error is generated at step S15, and ends the steps in step S10. In this case, the operator examines inside the housing 25.

Figure 6A:
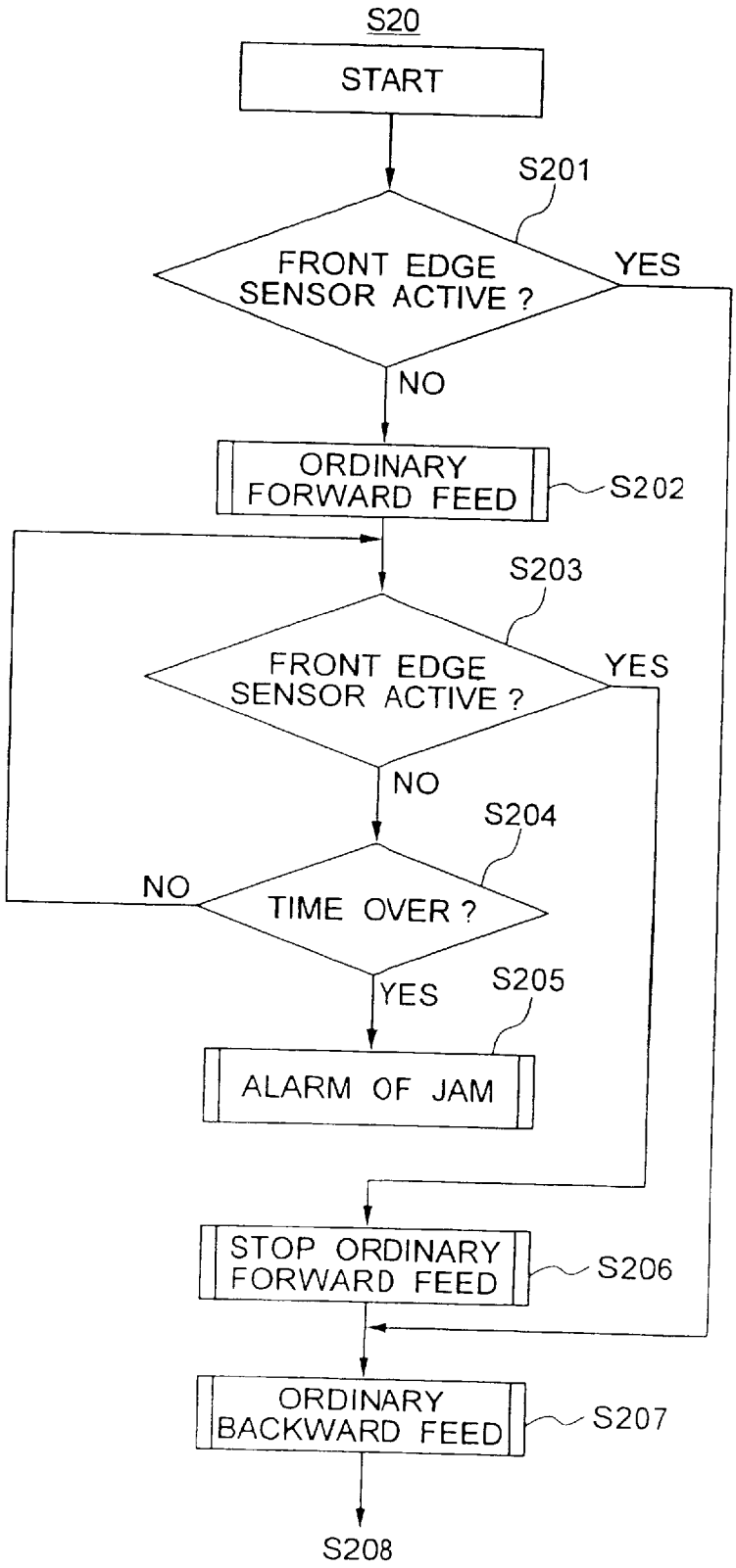
FIGS. 6A and 6B are detailed flowcharts for showing the steps in step 20 in FIG. 4.

Referring to FIG. 6A, step S20 shown in FIG. 4 includes a first judgement at step S201 for judging whether or not the front edge sensor 18 is active by detecting the recording sheet 24 disposed on the tractor 19. If the operator located, by a manual step before step S201, the recording sheet 24 onto the tractor 19 allowing the front edge of the recording sheet 24 to pass the front edge sensor 18, then the front edge sensor 18 is active at step S201. In this case, the sheet loading system operates for an ordinary backward feeding at step S207. On the other hand, if the operator located the recording sheet 24 such that the front edge of the recording sheet 24 resides in the rear side of the front edge sensor 18, then the front edge sensor 18 is inactive at step S201. In this case, the sheet loading system operates for an ordinary forward feed at step S202.

If the recording sheet 24 advances to make the front edge sensor 18 active within a specified time interval at a second judgement step S203, the ordinary forward feed is stopped at step S206. If it is judged at step S204 that the front edge sensor 18 does not detect the recording sheet 24 within the specified time interval, the sheet loading system judges a jam of the recording sheet 24 and generates an alarm at step 205 to stop the process. In this case, the operator examines inside the housing. After the ordinary forward feed is stopped at step S206, or it is judged at step S201 that the front edge sensor 18 is active, the process advances to step S207 for effecting an ordinary backward feed.

Figure 6B:
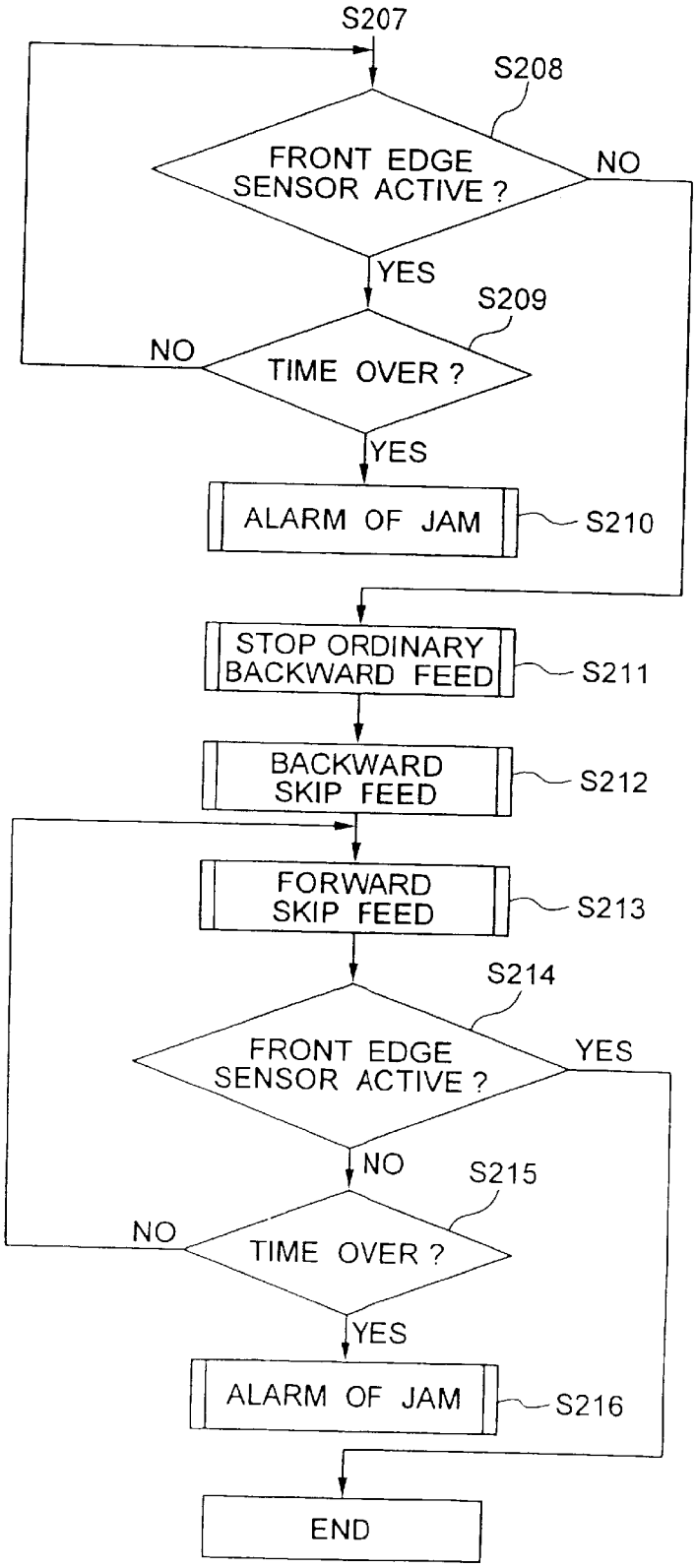

Referring to FIG. 6B showing the steps subsequent to the steps of FIG. 6A, it is judged again at a third judgement step S208 whether or not the front edge sensor 18 detects the recording sheet 24 within a specified time interval. If it is judged at step S209 that the front edge sensor 18 still detects the recording sheet 24 after the specified time interval, the sheet loading system judges generation of a jam of the recording sheet 24 and generates an alarm at step S210 to stop the process.

On the other hand, if the front edge sensor 18 does not detect the recording sheet at step S208, the process advances to step S211 for stopping the ordinary backward feed. Then, a single backward skip feed is effected at step S212. The single backward skip feed is conducted here for assuring that the front edge of the recording sheet resides in the rear side of the front edge sensor 18.

Thereafter, a forward skip feed is effected periodically at step S213 until it is judged at step S214 that the front edge sensor 18 detects the front edge portion of the recording sheet 24. If it is judged at step S215 the front edge sensor does not detect the recording sensor within a specified time interval, the sheet loading system generates an alarm at step S216 and stops the process. On the other hand, if the front edge sensor 18 successfully detects the recording sheet 24 at step S214, step S200 is completed.

At step S30 in FIG. 4, the recording sheet 24 having a front edge portion aligned with the front edge sensor 18 is forwarded by a specified amount, thereby allowing the front edge portion of the recording sheet 24 to pass the feed assist plates 17 and the fixing section 14. The CPU reads the data stored in the sheet length register 28, which stores the length of a single sheet to be cut from the continuous recording sheet 24 between the adjacent perforated lines thereof. If the length stored in the sheet length register 28 is equal to a default length, that is 11 inches, then one of the perforated lines 29 is aligned with the reference line 30 at this stage on the tractor 19 shown in FIG. 3B. Thus, the solenoid 15 is unexcited to allow the sheet assist plates 17 to be free. In this stage, the sheet assist plates 17 are raised by the recording sheet 24 itself and remains as before. If the sheet sensor 12 does not detect the recording sheet within a specified time interval at the exit of the fixing section 14, the sheet loading system generates an alarm for generation of a jam of the recording sheet.

In step S40, if the stored length is equal to the default, that is, the recording sheet has a perforated line at every 11 inches of the sheet, the recording sheet is not subjected to any operation. On the other hand, if the sheet size is not equal to the default, the CPU 10 calculates a further feed length based on the sheet size and the default sheet size to adjust the perforated line 29 of the recording sheet 24 on the tractor 19 to be aligned with the reference line 30 shown in FIG. 3B. Thus, the entire steps for the automated sheet loading is completed to locate the recording sheet at a start position for printing, which allows the printer to record image at a correct location of each cut sheet 24.

Since the above embodiments are described only for examples, the present invention is not limited to the above embodiments and various modifications or alterations can be easily made therefrom by those skilled in the art without departing from the scope of the present invention.

What is claimed is:

1. A recording device for recording image on a continuous recording sheet having a plurality of perforated lines disposed at a constant pitch, said recording device comprising a sheet loading system, said sheet loading system including a sheet feed mechanism for feeding the recording sheet, and a positioning unit for controlling said sheet feed mechanism to advance the recording sheet from an initial, just position to a second position at which one of said perforated lines is aligned with a reference position of said recording device said positioning unit controlling said sheet feeding mechanism to move said sheet both forward and backward to align said one of said perforated lines with said reference position.

2. The recording device as defined in claim 1, wherein said sheet feed mechanism includes a tractor having sprocket pins for engaging with sprocket holes of the recording sheet, and said sprocket pins are engaged with said sprocket holes when the recording sheet is at said initial first position.

3. The recording device as defined in claim 1, wherein said positioning unit comprises a front edge positioning section for controlling said sheet feed mechanism to feed the recording sheet to a third position at which a front edge of the recording sheet is aligned with another reference position of said recording device, and a constant amount feed section for controlling said sheet feed mechanism to advance the recording sheet from said third position by a specified amount to reach a forth position.

4. The recording device as defined in claim 3, wherein said positioning unit further comprises a sheet length register for storing said constant pitch, and a feed amount adjusting section for controlling said sheet feed mechanism to adjust a position of the recording sheet from said fourth position to said second position based on the stored constant pitch and a default pitch.

5. The recording device as defined in claim 3, wherein said front edge positioning section comprises a front edge sensor for detecting a part of the recording sheet, and controls said sheet feed mechanism to feed the recording sheet based on a signal from said front edge sensor in a plurality of modes, said plurality of modes including an ordinary forward feed mode, an ordinary backward feed mode, a forward skip feed mode and a backward skip feed mode.

6. The recording device as defined in claim 5, wherein said front edge positioning section controls said sheet feed mechanism to feed the recording sheet consecutively at least in said ordinary backward feed mode and in said forward skip feed mode.

7. The recording device as defined in claim 1, further including a feed assist plate for guiding a front edge of the recording sheet before the recording sheet reaches said second position.

8. The recording device as defined in claim 7, further including a sheet sensor for detecting the recording sheet after the front edge of the recording sheet passes said feed assist plate.

* * * * *